US007042157B2

(12) United States Patent
Chou

(10) Patent No.: US 7,042,157 B2
(45) Date of Patent: May 9, 2006

(54) LAMP BRACKET FOR COLD CATHODE LAMPS

(75) Inventor: Chin-Wen Chou, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 229 days.

(21) Appl. No.: 10/682,032

(22) Filed: Oct. 10, 2003

(65) Prior Publication Data

US 2005/0077827 A1 Apr. 14, 2005

(51) Int. Cl.

| | |
|---|---|
| ***H01J 5/48*** | (2006.01) |
| ***H01J 5/50*** | (2006.01) |
| ***H01J 17/18*** | (2006.01) |
| ***H01J 61/36*** | (2006.01) |

(52) U.S. Cl. ..... 313/624; 313/49; 313/50; 313/51

(58) Field of Classification Search ..... 313/624
See application file for complete search history.

(56) References Cited

U.S. PATENT DOCUMENTS

| | | | | |
|---|---|---|---|---|
| 5,649,759 | A * | 7/1997 | Korte | 362/659 |
| 5,666,172 | A * | 9/1997 | Ida et al. | 349/58 |
| 6,843,584 | B1 * | 1/2005 | Bang et al. | 362/249 |
| 2005/0026483 | A1 * | 2/2005 | Latsis | 439/157 |

* cited by examiner

*Primary Examiner*—Mariceli Santiago
*Assistant Examiner*—Elizabeth Rielley
(74) *Attorney, Agent, or Firm*—Birch, Stewart, Kolasch & Birch, LLP

(57) ABSTRACT

A lamp bracket structure for cold cathode lamps includes an anchor dock and a line coupling means. The anchor dock includes a cap, a bottom seat and a connecting section for connecting the cap to the bottom seat and allowing the cap to be moved relative to the bottom seat for opening and closing. The line coupling means is located between the cap and the bottom seat. When the cap is closed, the line coupling means clamps the power cord of a cold cathode lamp, and the line coupling means and the power supply end form electric connection. Thus the circuit of the power cord of the cold cathode lamp and the power supply end may be connected or separated rapidly.

12 Claims, 7 Drawing Sheets

LAMP BRACKET FOR COLD CATHODE LAMPS

FIELD OF THE INVENTION

The present invention relates to a circuit connector for cold cathode lamps and particularly to a lamp bracket structure that has an anchor dock consisting of a bottom seat and a cap openable and closable relative to each other to anchor the circuit of the power cord of a cold cathode lamp and a power supply end.

BACKGROUND OF THE INVENTION

In order to use space more efficiently and reduce the radiation to protect human health, conventional TV and computer CRT display device have been gradually replaced by new generation of liquid crystal display (LCD) and LCD TV. LCD is formed by sandwiching a layer of liquid crystals between two parallel and flat glass plates. There are many vertical and horizontal tiny electric wires laid between the two glass plates. By switching the electricity ON and OFF, the direction of the liquid crystals may be altered to refract light thereby to display pictures. It can be used to replace the CRT display device that generates a negative voltage from a cathode coil at the rear end thereof for driving an electronic gun to emit an electronic beam which bombards an arched glass coated with phosphide. Aside from making products thin and light, LCD also can greatly reduce radiation of the electronic gun.

However, service life of LCD is shorter than conventional CRT display device. Refer to FIG. 1 for a conventional lamp bracket for cold cathode lamps 3 to provide light source. When in use for a period of time the cathode lamps 3 will form black dots and affect light refraction of images. At present, the connection of lamp brackets 1' and an external power supply end 50 has to take into account of the fragile thin and lengthy cold cathode lamps 3, hence the lamp brackets 1' are firstly mounted onto two sides of the base board 2 for holding the cold cathode lamps 3, then the power cord 30 of each cold cathode lamp 3 is soldered on the external power supply end 50 to form soldering points 60. However, in the event that any one of the cold cathode lamps 3 breaks or generates black dots, the soldering points 60 have to be removed for repairing or replacing the cold cathode lamp 3. Reinstalling the cold cathode lamp 3 has to do the soldering again to connect the line. Thus to immediately replace a single cold cathode lamp 3 is difficult. It causes a great problem on repairs and maintenance. Moreover, line connection also incurs other issues. For instance, in the event that one of the LCD lamp brackets 1' is damaged (even for only one cold cathode lamp 3), the entire lamp bracket has to be discarded. This not only has negative impact on the service life of LCD, also results in serious environmental protection concerns.

SUMMARY OF THE INVENTION

The primary object of the invention is to provide a lamp bracket structure to facilitate replacement of cold cathode lamps. The lamp bracket according to the invention has an anchor dock that forms a circuit connection between the power cord of a cold cathode lamp and the power supply end by merely pressing a cap so that replacing the cold cathode lamp is more convenient. The lamp bracket includes a line coupling means for connecting the power cord of the cold cathode lamp and the circuit of the power supply end and an anchor dock which has a bottom seat and a cap movable relative to each other to form a latching to anchor the circuit of the power cord of the cold cathode lamp and the power supply end.

Another object of the invention is to provide a lamp bracket structure for replacing the cold cathode lamp without generating debris. As the invention uses the anchor dock to latch and connect the circuit, it does not produce debris as the conventional technique that connects the circuit by soldering. It also greatly reduces the probability of forming bright dots on the LCD panel during replacing the cold cathode lamp.

Yet another object of the invention is to provide an improved fabrication method for producing the back light unit. The invention provides an insertion leg for directly inserting into the bottom seat to connect the circuit board to provide power supply.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
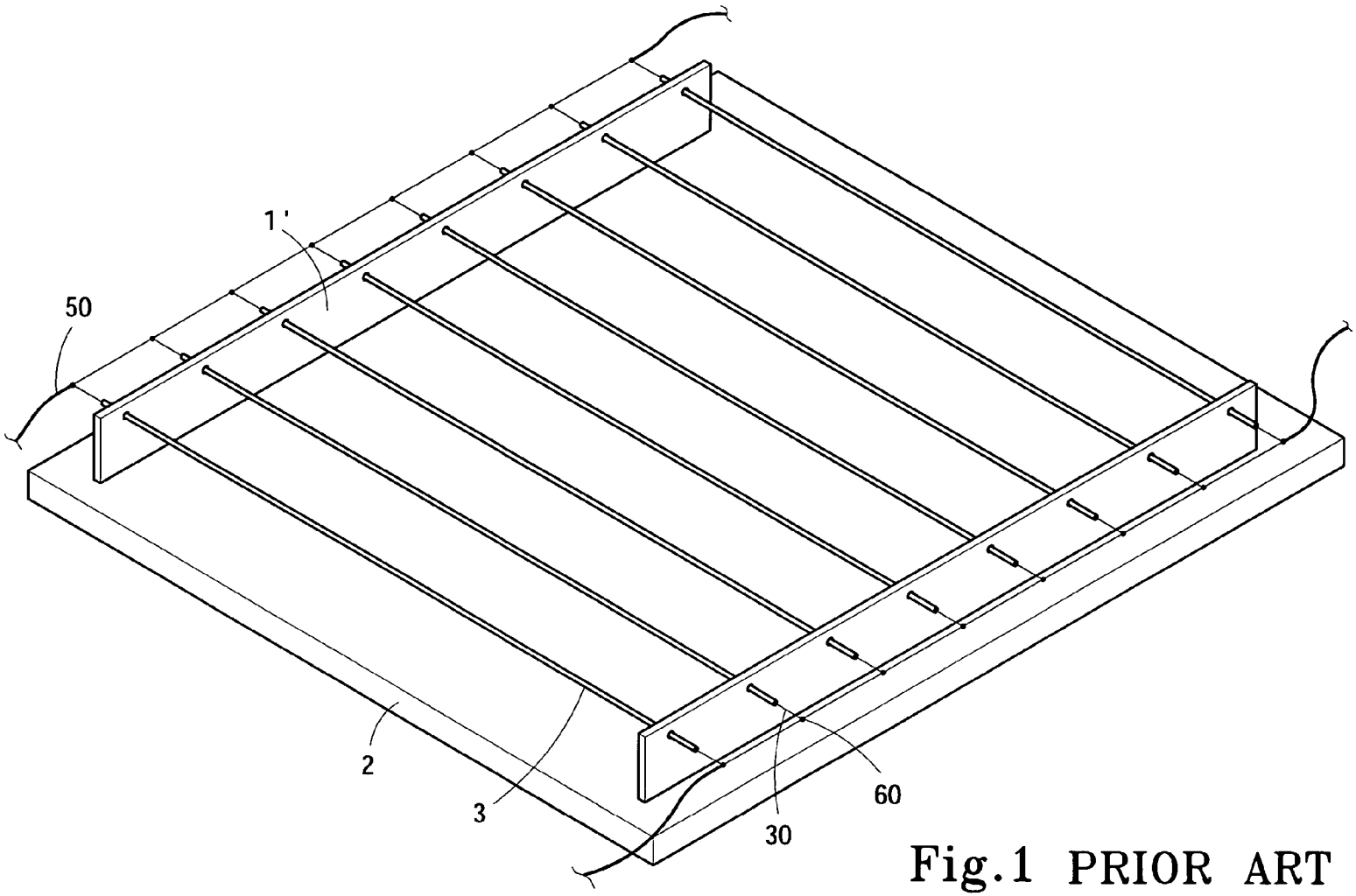
Fig.1 PRIOR ART
FIG. 1 is a schematic view of a conventional lamp bracket for cold cathode lamps.
Figure 2:
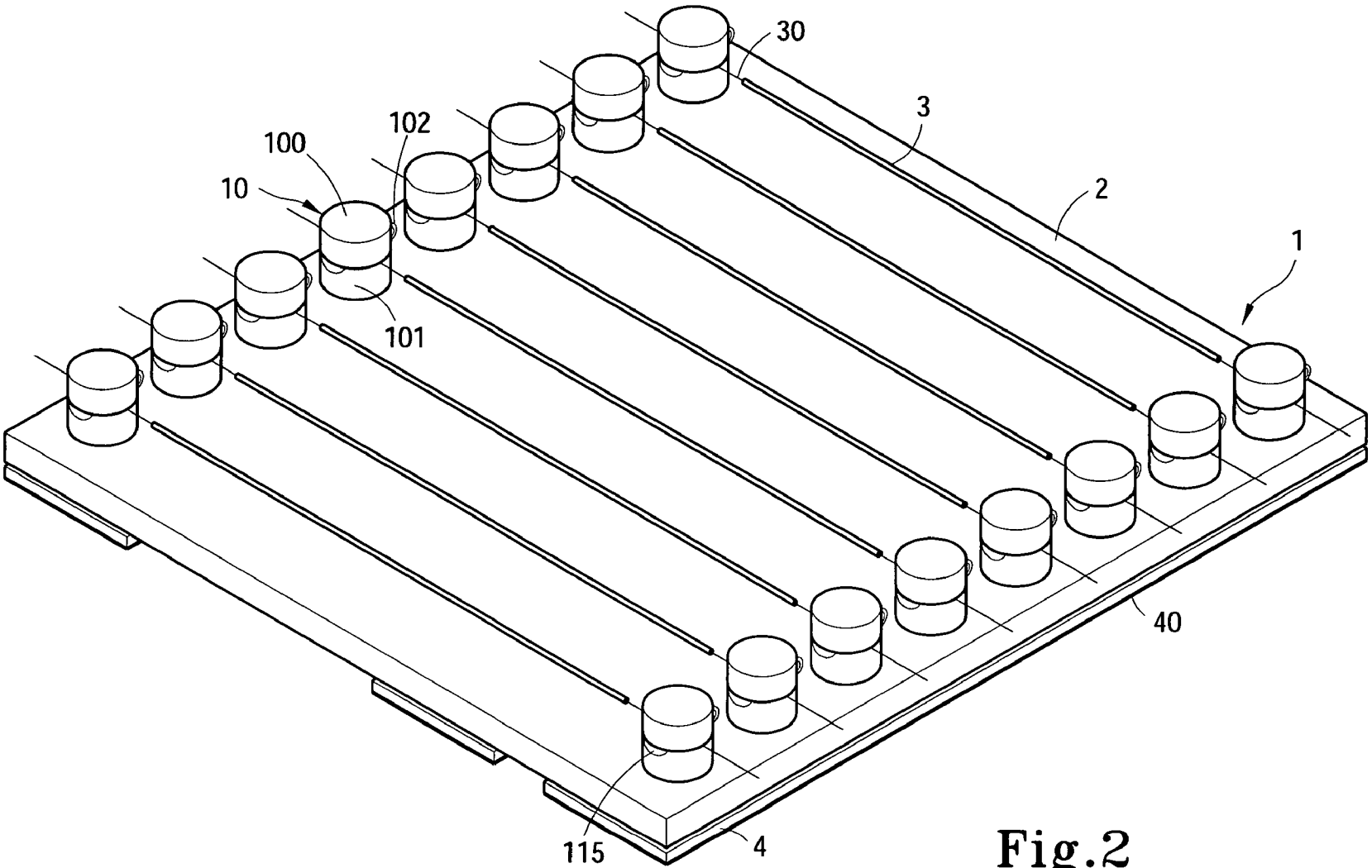
FIG. 2 is a perspective view of a first embodiment of the present invention.
Figure 4A:
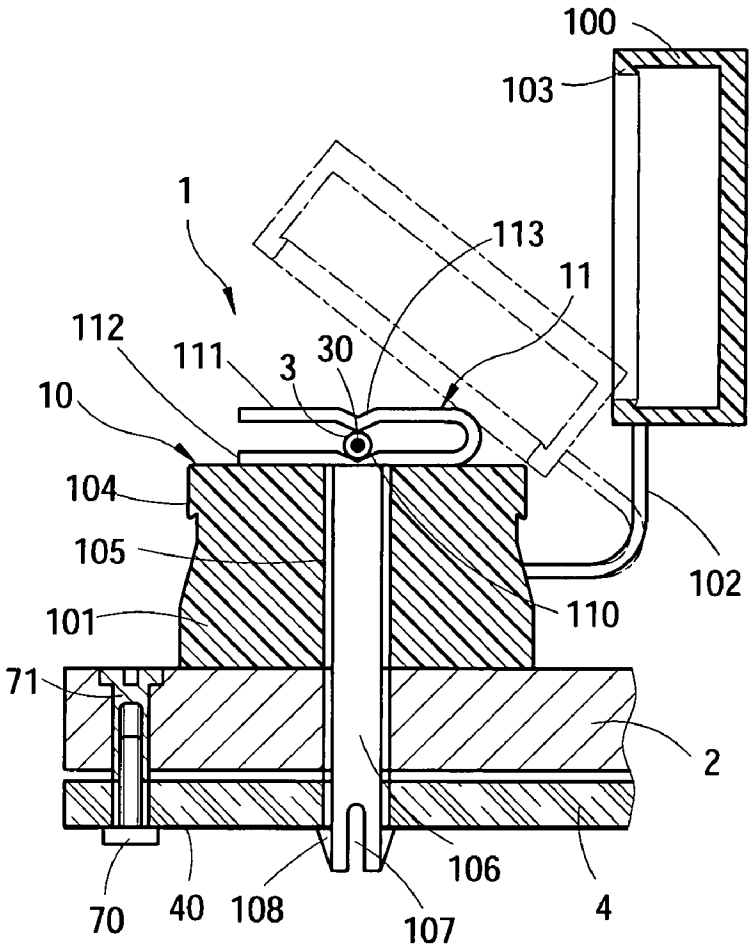
FIG. 4A is a schematic view of the first embodiment in an operating condition.

Please refer to FIGS. 2 and 4A, the lamp bracket 1 according to the invention is located respectively on two sides of a base board 2 for bracing two ends of a cold cathode lamp 3. The cold cathode lamp 3 has a power cord 30 which also is held by the lamp bracket 1. The base board 2 has a bottom which is connected and fastened to a circuit board 4 through a brass strut 71 and a fastening element 70.

The fastening element 70 usually is a screw. The circuit board 4 provides power supply to the power cord 30 of the cold cathode lamp 3.

Figure 3:
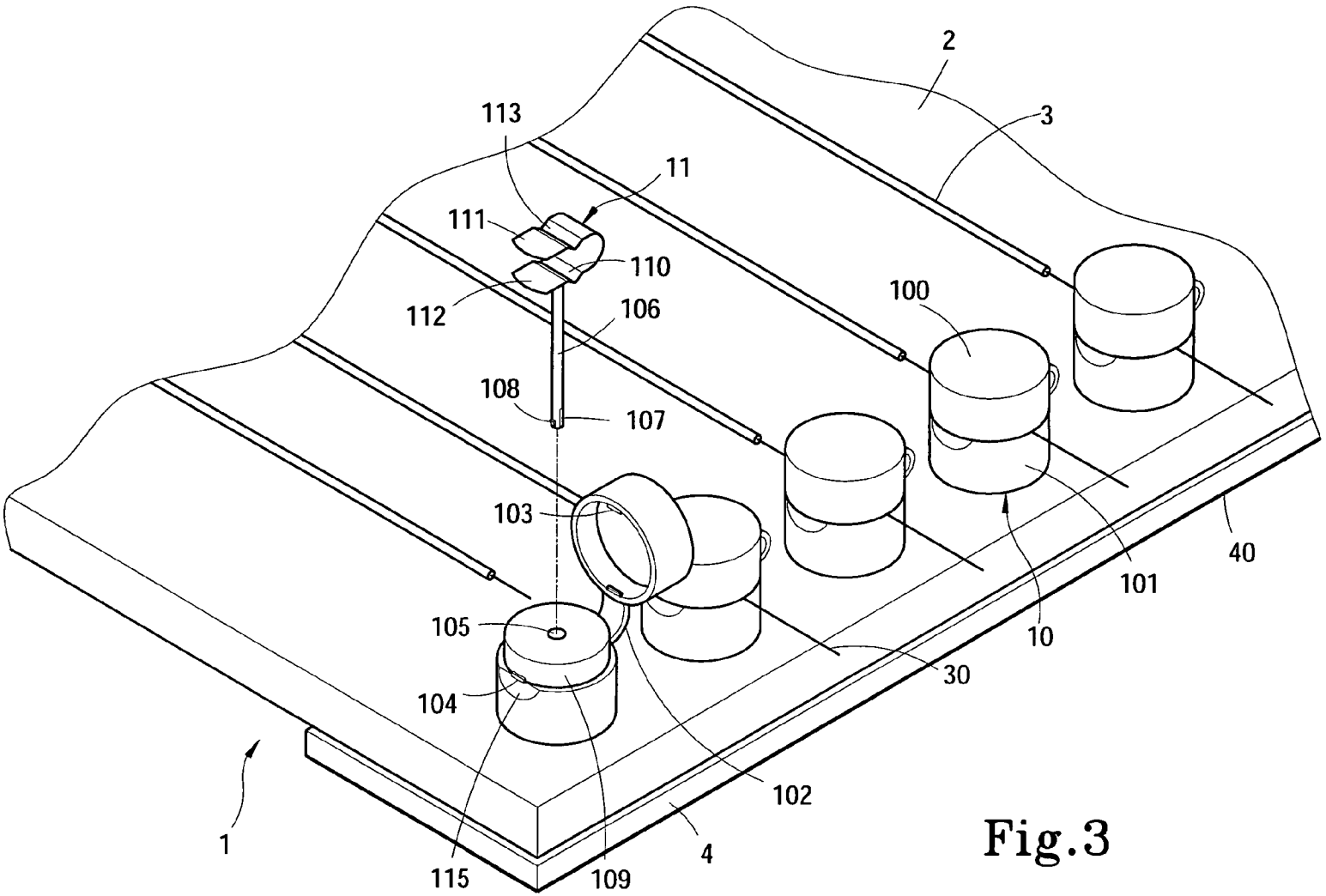
FIG. 3 is a fragmentary exploded view of the first embodiment of the present invention.

Referring to FIG. 3, the lamp bracket 1 includes an anchor dock 10 which has a cap 100, a bottom seat 101 and a connecting section 102 for linking the cap 100 to the bottom seat 101. The cap 100, bottom seat 101 and connecting section 102 may be formed in an integrated structure without separation. The connecting section 102 is made from a flexible material and bendable so that the cap 100 and the bottom seat 101 may be moved relative to each other for opening and closing. Moreover, the cap 100 and the bottom seat 101 have one side opposite to the connecting section 102 to form a first latch section 103 and a second latch section 104 that are shaped to mate and latch with each other when the cap 100 and the bottom seat 101 are coupled and closed. They may also be unlatched and separated. In addition, the bottom seat 101 has an indentation 115 on a lateral side opposite to the connecting section 102 that forms an inward notch from the outer rim of the cap 100 so that the cap 100 forms a jutting end to receive force and facilitate opening. Furthermore, a line coupling means 11 is provided. It is integrally made and bendable to form an upper coupling member 111 and a lower coupling member 112. The line coupling means 11 is located between the bottom seat 101 and the cap 100 of the anchor dock 10. The lower coupling member 112 has a lead trough 110 for holding the power cord 30 of the cold cathode lamp 3. The upper coupling member 111 has a compression bump 113 mating the shape and location of the lead trough 110. The line coupling means 11 is made from a conductive metal.

The bottom seat 101 has a protrusive top end 109 mating the shape of the cap 100, and also forming a reserved space to accommodate the line coupling means 11. When the cap 100 is closed, it forms a tightly coupling with the bottom seat 101. The bottom seat 101 has a through hole 105 in the center for housing an insertion leg 106. The through hole 105 is extended downwards to the base board 2 and the circuit board 4. The insertion leg 106 is coupled on a power supply end (not shown in the drawings) of the circuit board 4 through a tenon 108 and connected to the lower coupling member 112 so that the power cord 30 of the cold cathode lamp 3 is connected to the circuit of the power supply end of the circuit board 4.

Figure 4B:
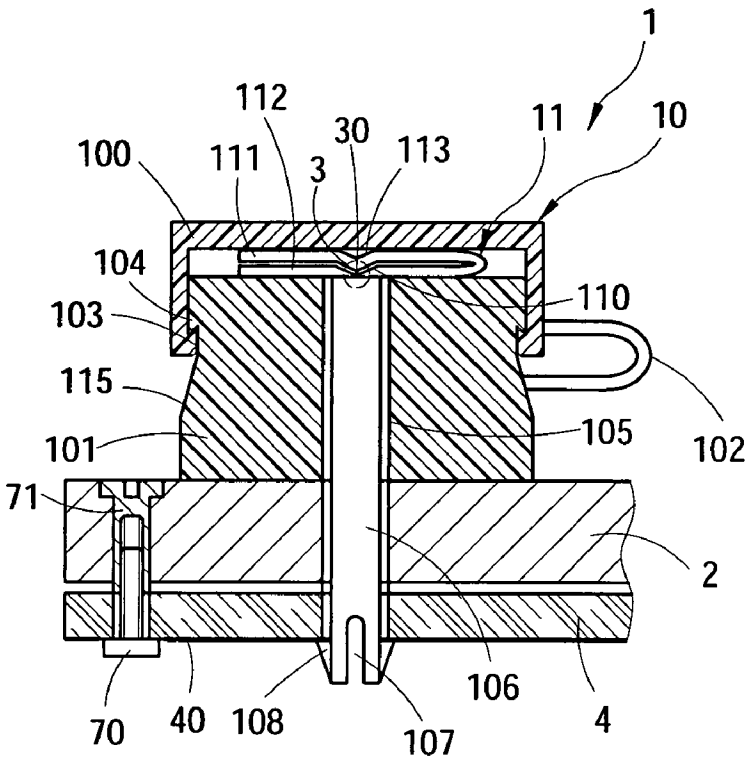
FIG. 4B is a schematic view of the first embodiment in another operating condition.

Referring to FIGS. 3, 4A and 4B, the lamp brackets 1 are located on two sides of the base board 2 for holding the cold cathode lamp 3. The power cord 30 of the cold cathode lamp 3 is placed in the lead trough 110 of the lower coupling member 112. The insertion leg 106 is connected to the circuit board 4 and the connecting section 102. The insertion leg 106 has a notch 107 and a tenon 108 at the bottom so that the tenon 108 may be compressed and retracted towards the notch 107 when being inserted in the through hole 105. Once the insertion leg 106 runs through the bottom of the circuit board 4, the tenon 108 expands to latch on the circuit board 4 so that the insertion leg 106 may be securely inserted and mounted on a plated layer 40 of the circuit board 4. Meanwhile, the power cord 30 of the cold cathode lamp 3 on the line coupling means 11 is connected to the circuit board 4 through the insertion leg 106, and connected to the power supply end of the circuit board 4 through the plated layer 40 to supply power supply. When the cap 100 is closed, the compression bump 113 of the upper coupling member 111 is coupled on the lead trough 110 of the lower coupling member 112. At the same time, the power cord 30 of the cold cathode lamp 3 is connected to the power supply end and anchored. In the event that replacing the cold cathode lamp 3 is required, open the cap 100, remove the power cord 30 of the cold cathode lamp 3 from the line coupling means 11, replacement can be accomplished easily.

Figure 8:
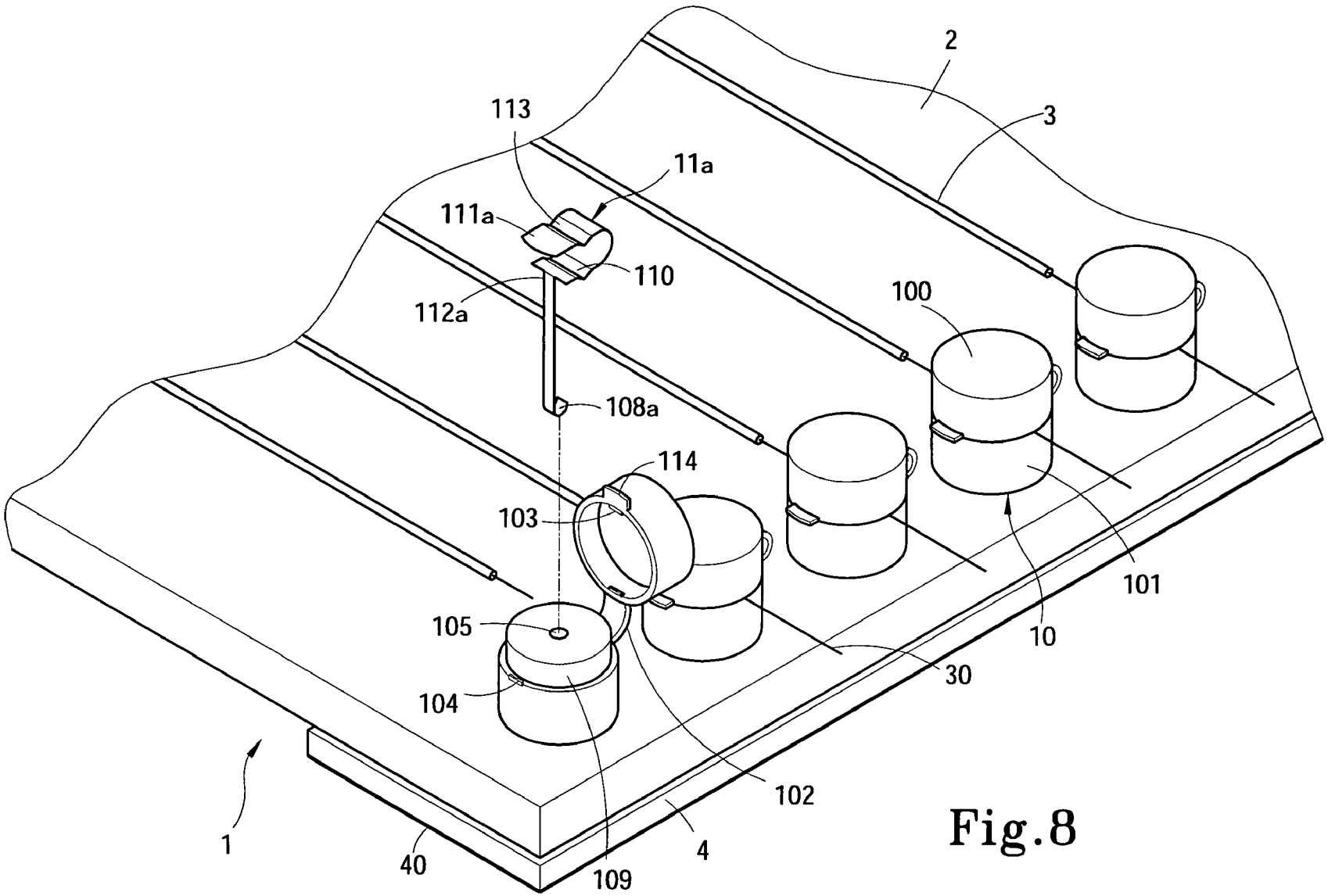
FIG. 8 is a fragmentary exploded view of a fifth embodiment of the present invention.

Referring to FIG. 8, the line coupling means 11a is integrated and inseparable. It consists of an upper coupling member 111*a*, a lower coupling member 112*a* and an insertion leg 106*a*. The size of the insertion leg 106*a* mates the size of the through hole 105. The insertion leg 106*a* has a distal end forming a tenon 108*a* which has an inverse hook at the tail end. After the insertion leg 106*a* is inserted into the through hole 105, it can latch on the circuit board 4. Moreover, the cap 100 has a jutting section 114 on the opposite side of the connecting section 102 to receive force and facilitate opening of the cap 100.

Figure 5A:
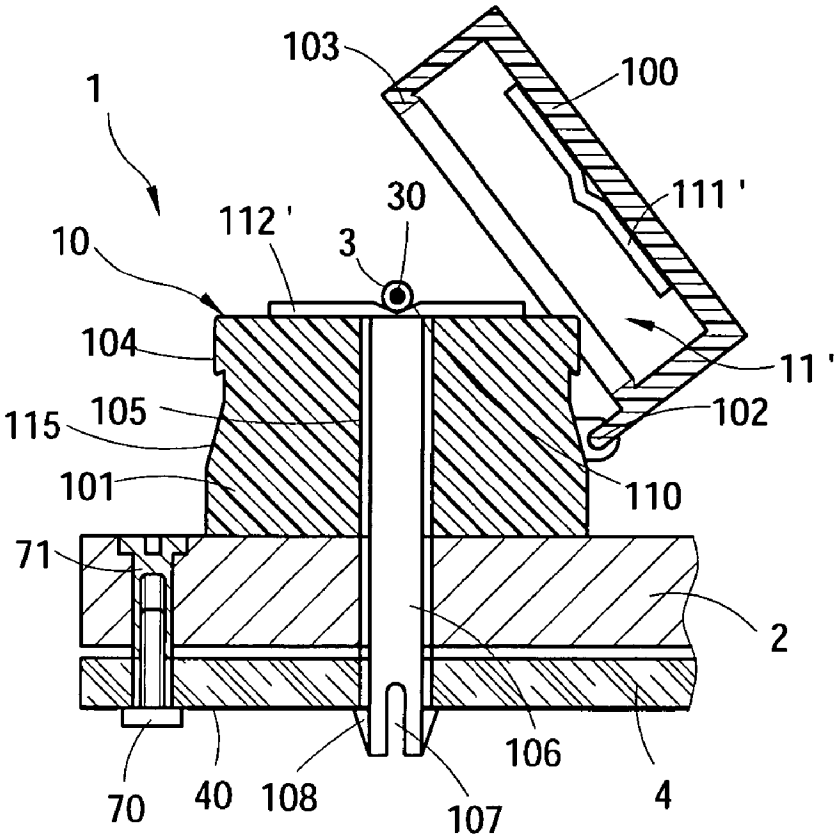
FIG. 5A is a schematic view of a second embodiment in an operating condition.
Figure 5B:
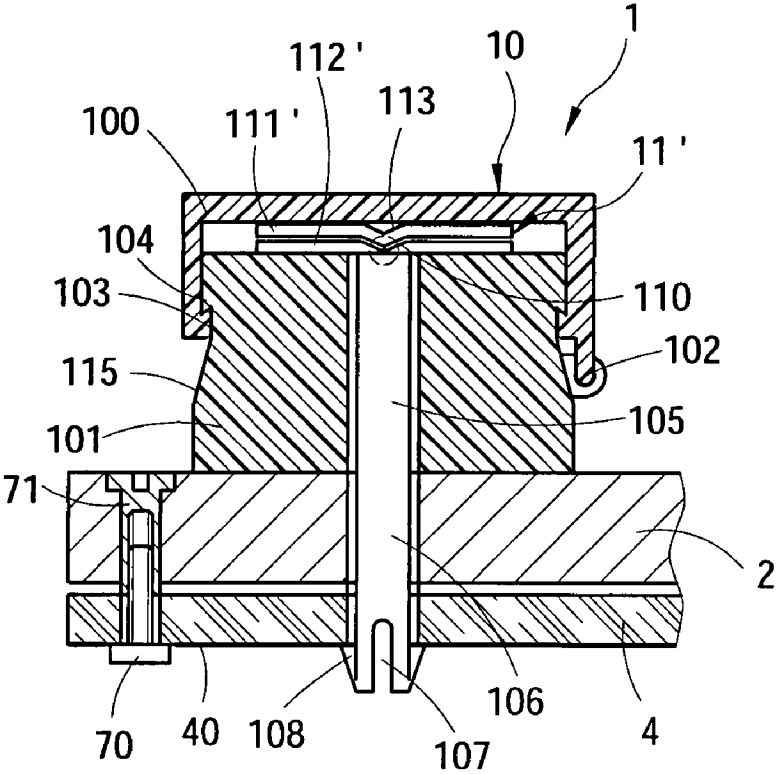
FIG. 5B is a schematic view of the second embodiment in another operating condition.
Figure 7:
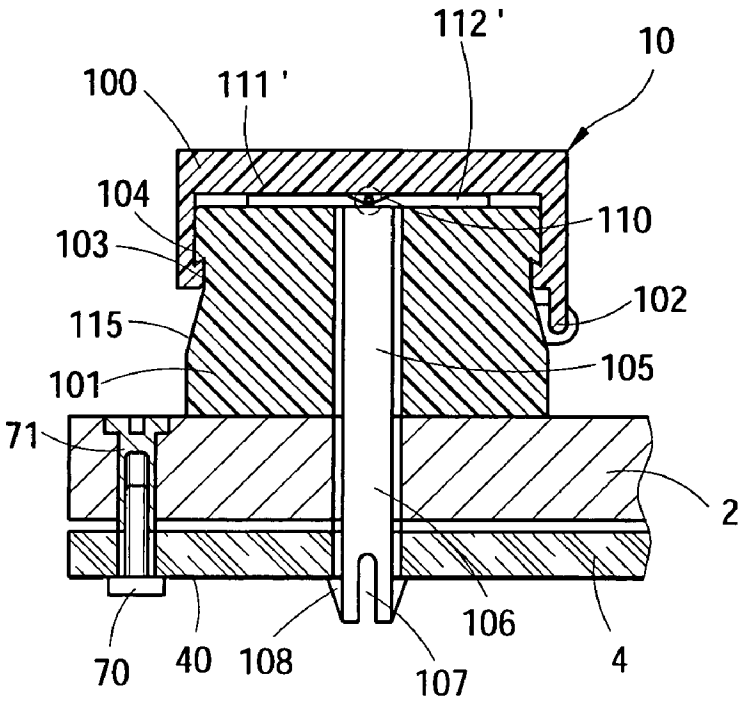
FIG. 7 is a sectional view of a fourth embodiment of the present invention.

Refer to FIGS. 5A and 5B for another embodiment of the lamp bracket 1'. The line coupling means 11' is separable. It includes an upper coupling member 111' and a lower coupling member 112'. The upper coupling member 111' is fixed on the cap 100. The lower coupling member 112' is fixed on the bottom seat 101. The power cord 30 is clamped between the line coupling means 11'. The connecting section 102 is a hinge. The operation is same as the one depicted before. Refer to FIG. 7 for yet another embodiment of the invention. The line coupling means 11' has a single lower coupling member 112' located on the bottom seat 101 to clamp the power cord 30 between the cap 100 and the lower coupling member 112'.

Figure 6:
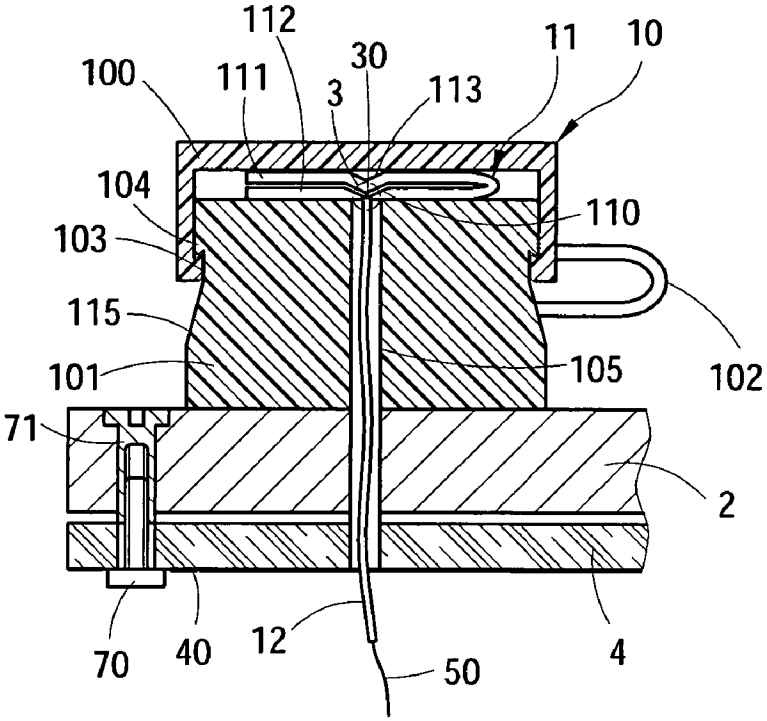
FIG. 6 is a sectional view of a third embodiment of the present invention.

Refer to FIG. 6, the insertion leg 106 of the line coupling means 11 may also be a metal wire 12 running through the through hole 105 and extending outside the circuit board 4 to connect to the external power supply end 50 to receive the external power supply.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lamp bracket for cold cathode lamps adapted for using on a connection circuit of a power cord of a cold cathode lamp and a power supply end to connect to a circuit board, comprising:

an anchor dock having a bottom seat and a cap movable to cover said bottom seat for opening or closing; and at least one line coupling means located between said bottom seat and said cap and made from metal sheet for connecting said power cord of said cold cathode lamp, wherein said bottom seat has a through hole in the center for housing an insertion leg to connect said line coupling means and said power supply end.

2. The lamp bracket for cold cathode lamps of claim 1, wherein said cap and said bottom seat have respectively a first latch section and a second latch section that have mating shapes for coupling with each other to latch said cap and said bottom seat.

3. The lamp bracket for cold cathode lamps of claim 1, wherein said insertion leg has a distal end forming a tenon and a notch, said tenon being latchable on said circuit board through said through hole and retractable towards said notch during insertion in said through hole.

4. The lamp bracket for cold cathode lamps of claim 1, wherein said line coupling means is integrated and bent to form an upper coupling member and a lower coupling member, said lower coupling member being fixedly mounted onto said bottom seat of said anchor dock.

5. The lamp bracket for cold cathode lamps of claim 4, wherein the upper coupling member has a lead trough and said lower coupling member has a compression bump mating the shape of said lead trough.

6. The lamp bracket for cold cathode lamps of claim 1, wherein said line coupling means is integrated and bent to form an upper coupling member and a lower coupling member, said lower coupling member being connected to an insertion leg which is connected to said power supply end.

7. The lamp bracket for cold cathode lamps of claim 1, wherein said line coupling means includes an upper coupling member fixedly located on said cap and a lower coupling member fixedly located on said bottom seat.

8. The lamp bracket for cold cathode lamps of claim 7, wherein said upper coupling member has a lead trough and said lower coupling member has a compression bump mating the shape of said lead trough.

9. The lamp bracket for cold cathode lamps of claim 1, wherein said anchor dock has a connecting section for linking said cap and said bottom seat.

10. The lamp bracket for cold cathode lamps of claim 9, wherein said connecting section is a hinge.

11. A lamp bracket for cold cathode lamps adapted for using on a connection circuit of a power cord of a cold cathode lamp and a power supply end to connect to a circuit board, comprising:

an anchor dock having a bottom seat and a cap movable to cover said bottom seat for opening or closing; and at least one line coupling means located between said bottom seat and said cap and made from metal sheet for connecting said power cord of said cold cathode lamp, wherein said line coupling means has a lower end connecting to a metal wire which is linked to said power supply end.

12. A lamp bracket for cold cathode lamps adapted for using on a connection circuit of a power cord of a cold cathode lamp and a power supply end to connect to a circuit board, comprising:

an anchor dock having a bottom seat and a cap movable to cover said bottom seat for opening or closing; and at least one line coupling means located between said bottom seat and said cap and made from metal sheet for connecting said power cord of said cold cathode lamp, wherein said anchor dock has a connecting section for linking said cap and said bottom seat, and wherein said cap, said bottom seat and said connecting section are integrated and inseparable, said connecting section being pliable and bendable to allow said cap to move relative to said bottom seat for opening and closing.

* * * * *